US005572752A

United States Patent [19]

McGee

[11] Patent Number: 5,572,752

[45] Date of Patent: Nov. 12, 1996

[54] BED WITH AXIAL GLIDER MOVEMENT

[76] Inventor: Mickie L. W. McGee, 4515 21st St., Lubbock, Tex. 79407

[21] Appl. No.: 564,452

[22] Filed: Nov. 29, 1995

[51] Int. Cl.[6] ..... A47D 9/00; A47D 9/02

[52] U.S. Cl. ..... 5/103; 5/101

[58] Field of Search ..... 5/103, 101, 102, 5/105, 108, 93.1, 109; 297/281, 273; 248/370

[56] References Cited

U.S. PATENT DOCUMENTS

| | | | |
|---|---|---|---|
| 138,320 | 4/1873 | Doremus | 5/101 |
| 367,222 | 7/1887 | Miller | 5/107 |
| 509,848 | 4/1893 | Hannahs | 5/103 |
| 1,906,768 | 5/1933 | Romine | 472/118 |
| 1,965,785 | 7/1934 | Vallone | 5/103 |
| 2,532,236 | 11/1950 | Klazkin | 5/103 |
| 3,648,307 | 3/1972 | Meade | 5/93.1 |
| 4,970,740 | 11/1990 | Crawford | 5/103 |
| 5,123,701 | 6/1992 | Bottamiller | 5/108 |
| 5,326,327 | 7/1994 | Stephens et al. | 297/261 |

*Primary Examiner*—Alexander Grosz
*Attorney, Agent, or Firm*—Norman B. Rainer

[57] ABSTRACT

A bed suitable for use by infants or invalids includes a stationary base and a mattress-holding bed frame of box-like rectangular configuration in surrounding relationship about the base. Four tether arms pivotably and pendently attach the bed frame to the base in a manner permitting an axial glider movement of the bed frame.

3 Claims, 1 Drawing Sheet

BED WITH AXIAL GLIDER MOVEMENT

BACKGROUND OF THE INVENTION

1. Field of the Invention

This invention concerns a bed for an infant or invalid, and more particularly relates to a bed having confining side panels and adapted for reciprocating movement in the direction of the long axis of the bed.

2. Description of the Prior Art

Numerous cradles have been disclosed for infants wherein provision is made to apply a rocking motion in a direction transverse to the long axis of the eradie. Infant's cribs, provided with restraining side panels, have been provided with arcuate rocker legs, as disclosed in U.S. Pat. No. 367,222 to permit said rocking motion.

Suspended restraining chairs for infants have been disclosed in U.S. Pat. Nos. 1,906,768 and 5,326,327 wherein a seat portion is suspended from paired pivot arms, thereby enabling the seat portion to have a glider-type of movement. Said glider-type movement may be characterized as a movement wherein the seat portion remains in horizontal disposition but is transported back and fourth successively between forward and rearward extremities or apogees. The movement describes an arcuate path wherein the center point, or state of rest, is at a lower elevation that the apogee points. As a consequence of such path characteristics, the individual experiencing such motion will feel an uplifting effect at the extremity of each oscillation.

If U.S. Pat. No. 3,648,307 to Meade discloses a child's bed consisting of an interior framework suspended from a stationary exterior framework and adapted to swing in a glider-type movement in a direction transverse to the long axis of the bed. One disadvantage of the Meade bed is that its swingable nature causes difficulties for a caregiver providing routine the needs of a baby from a side of the bed.

The present invention derives in part from the discovery that a glider-type movement can promote a soothing and calming effect upon an infant and upon persons with severe mental retardation when said movement is in the direction of the long axis of the bed, or otherwise described as the "end-to-end" direction. It has further been discovered that, with proper construction, a crib may be capable of end-to-end glider movement activated solely by movement of the occupant without need for motorized assistance.

It is further desirable that a child's crib be convertible to an item of furniture which is useful as a couch or bed even after it has been outgrown by the infant.

It is accordingly an object of the present invention to provide a bed apparatus capable of undergoing glider-type movement in the direction of the long axis of the bed.

It is another object of this invention to provide a bed apparatus as in the foregoing object useful in the caring for infants or invalids.

It is a further object of the present invention to provide a bed apparatus of the aforesaid nature wherein said glider-type of movement can be produced by the occupant of the bed.

It is still another object of this invention to provide a bed apparatus of the aforesaid nature which can be converted to an item of conventional household furniture.

It is yet another object of the present invention to provide a bed apparatus of the aforesaid nature of simple, durable construction amenable to low cost manufacture, apparent from the following description.

SUMMARY OF THE INVENTION

The above and other beneficial objects and advantages are accomplished in accordance with the present invention by a bed apparatus comprising:

a) a stationary base assembly elongated upon a longitudinal axis between opposed front and rear extremities having paired upper support means symmetrically spaced about said axis, the locus of said upper support means being a rectangle disposed in a horizontal plane, b) a tether arm held by each upper support means and directed downwardly therefrom, terminating in a lower extremity, c) a bed frame comprised of opposed vertical side panels and vertical front and rear panels assembled in box-like rectangular configuration in surrounding relationship about said base assembly, d) lower support means associated with said side panels directly beneath the corresponding upper support means and engaging the lower extremities of said tether arms, e) shelf means associated with said bed frame to secure a mattress in horizontal disposition, and f) a horizontally disposed guard panel positioned between said shelf means and base assembly.

In a preferred embodiment, all panels of said bed frame are of considerable height for the purpose of retaining infants and invalids. Said panels may be constructed of spaced apart vertical bars, or of other equivalent construction which does not restrict air flow or visual access to the individual in the bed. One or both of the side panels may be removable or downwardly adjustable so as to better enable the care-providing person to reach into the bed frame for the purpose of servicing the individual. Said tether arm may be held by pivot means associated with said upper support means. Also, the engagement of the lower extremity of each tether arm with said lower support means may be by way of pivot means.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
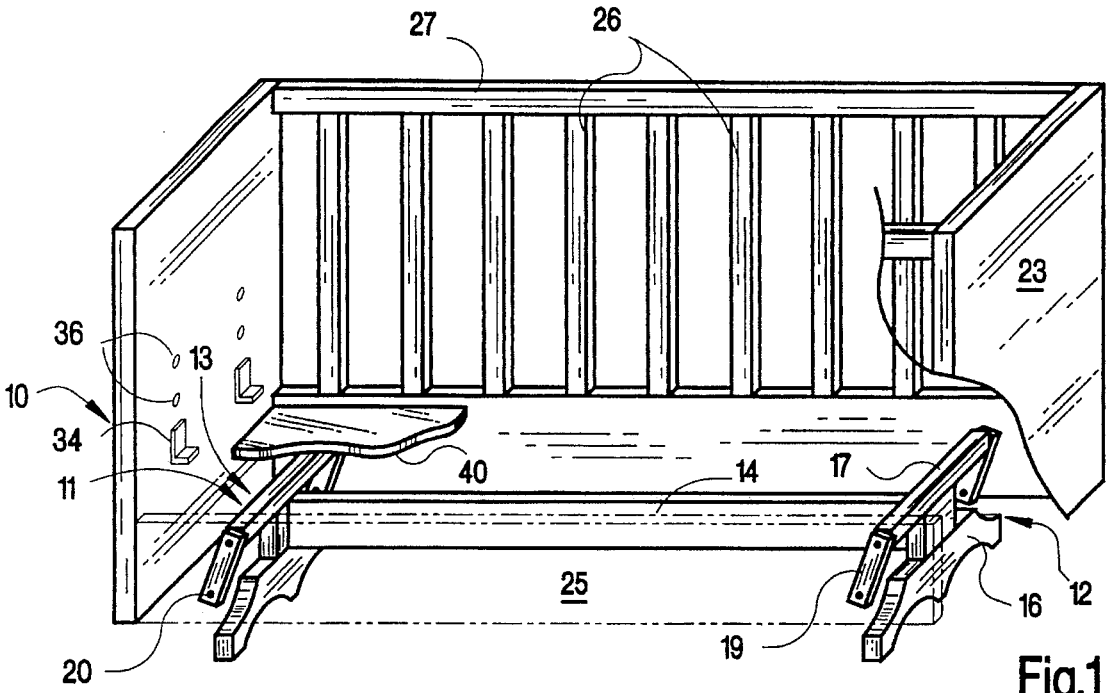
FIG. 1 is a perspective side view of an embodiment of the bed of this invention with portions broken away to reveal interior details.
Figure 2:
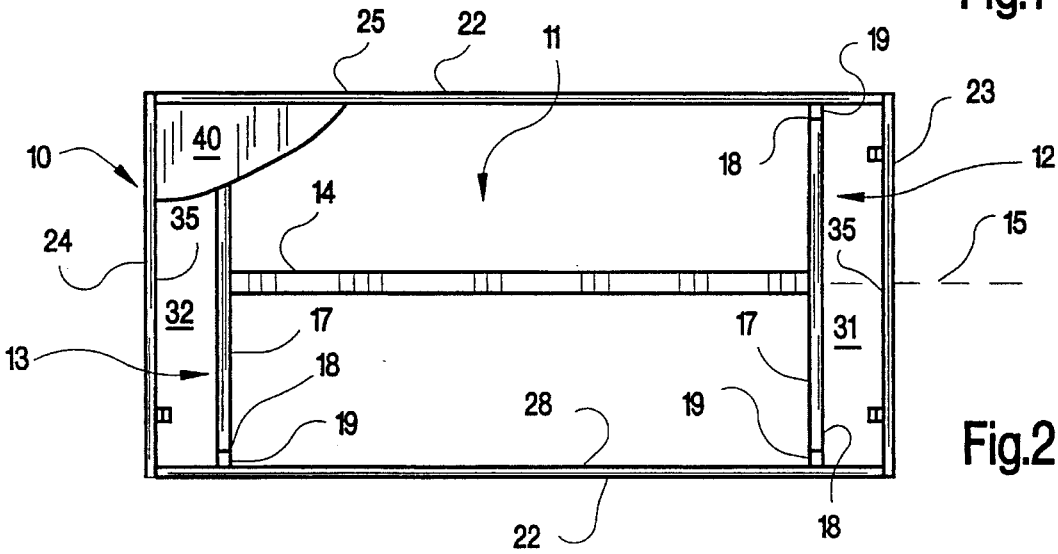
FIG. 2 is a top view.
Figure 3:
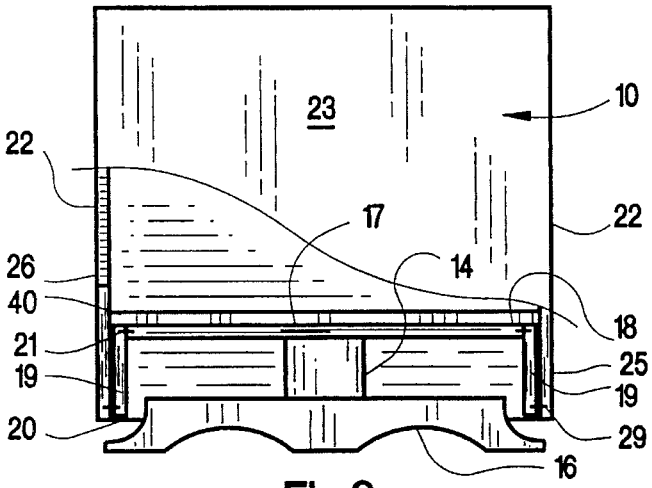
FIG. 3 is a front end view with portions broken away.

Referring to FIGS. 1–4, an embodiment of the bed of the present invention is shown comprised of bed frame 10 disposed about stationary base assembly 11.

Said base assembly is comprised of opposed front and rear pedestal extremities 12 and 13, respectively, and elongated beam 14 disposed upon longitudinal center axis 15 and extending in joinder between said pedestal extremities. Each pedestal extremity is comprised of footing member 16 disposed generally below longitudinal beam 14, and transverse beam 17 whose opposed lateral extremities function, as well hereinafter be shown, as paired upper support means 18 symmetrically spaced about axis 15. The locus of the aggregate four upper support means 18 of said front and rear pedestal extremities is a rectangle disposed in a horizontal plane and centered upon axis 15.

Figure 4:
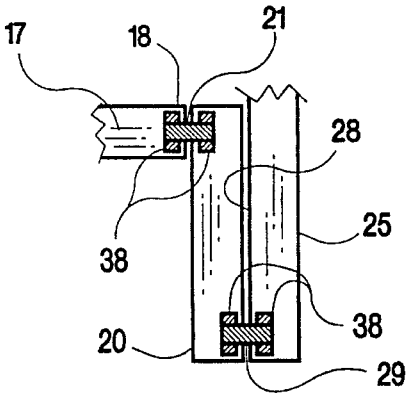
FIG. 4 is an enlarged fragmentary front end view.

A tether arm 19 is pivotally held by each support means 18 and directed downwardly therefrom, terminating in lower extremity 20. Said tether arm is an elongated member which may be of rigid construction fabricated of wood, metal or engineering grade plastic. In other embodiments however, the arm may be a compliant but non-elongating member such as a cable, rope webbing or the like. In the illustrated embodiment, the upper extremity of each arm is attached by way of a securing pin 21 to upper support means 18 at the lateral extremity of transverse beam 17. Pin 21 may permit pivoting movement by way of journaled joinder with either or both the tether arm and transverse beam as shown in FIG. 4, whereby the tether arm is permitted to swing in substantially frictionless manner in a vertical path. Other modes of attachment of tether arm 19 to said transverse beam are contemplated as being within the purview of this invention wherein equivalent frictionless swinging freedom is imparted to said tether arm.

Bed frame 10 is comprised of opposed side panels 22, and front and rear panels 23 and 24, respectively, assembled in box-like rectangular configuration in surrounding relationship about base assembly 11. In the illustrated embodiment, the lower extremities of said side panels are comprised of solid structural strips 25. The upper portions of said side panels are comprised of a series of vertical bars 26 which extend in joinder between said bottom strip and an upper rail 27. In alternative embodiments, one or both side panels may be constructed so as to fold downwardly toward the outside of the bed, the site of folding being along a horizontal line approximately two thirds of the way up the side panel. Said front and rear panels are spaced apart from the corresponding pedestal extremities, forming front and rear clearance regions 31 and 32, respectively, thereby permitting reciprocating axial movement of said bed frame about the stationary base assembly.

The lower extremity 20 of each tether arm 19 is associated with the interior surface 28 of a corresponding structural strip 25, said association being achieved by way of lower support means in the form of horizontally disposed rod 29 held by strip 25. As in the case of the attachment of the upper extremity of the tether arm to transverse beam 17, the securement of lower extremity 20 of said arm preferably employs conventional friction-reducing bushing or bearing means. For example, rod 29 may engage ball bearing retainer rings 38 recessed into both interior surface 28 and tether arm 19. The overall effect of the aforesaid components and their interaction is to suspend bed frame 10 upon said tether arms, enabling said bed frame to swing in glider-type motion along axis 15.

Shelf means in the form of four holding brackets 34 secured to the interior surfaces 35 of said front and rear panels provide a support for a conventional mattress frame and mattress, not shown. Brackets 34 may be adjustable and removably positioned at different elevations by way of frictional engagement with sockets 36 disposed in a vertical series in said interior surfaces 35.

A guard panel 40 is horizontally disposed between brackets 34 and the uppermost portion of base assembly 11, and is removably secured to strips 25 and front and rear panels 23 and 24. The purpose of said guard panel is to enhance the safety of the bed by preventing the inadvertent entrance of hands into the glider mechanism.

The entire bed of this invention may be fabricated in a manner which permits disassembling to a compact storage state. The manner of construction may also permit selective removal and replacement of components, thereby enabling the bed to be employed either for infants or invalids, or as conventional furniture.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A bed apparatus comprising:

a) a stationary base assembly elongated upon a longitudinal axis between opposed front and rear extremities having paired upper support means symmetrically spaced about said axis, the locus of said upper support means being a rectangle disposed in a horizontal plane, b) a tether arm rotatably held by each upper support means and directed downwardly therefrom, terminating in a lower extremity, c) a bed frame comprised of opposed vertical side panels and vertical front and rear panels assembled in box-like rectangular configuration in surrounding relationship about said base assembly, d) lower support means comprised of solid structural strips defining lower portions of said side panels directly beneath the corresponding upper support means and rotatably engaging the lower extremities of said tether arms, e) shelf means associated with said bed frame to secure a mattress in horizontal disposition, f) a horizontally disposed guard panel positioned between said shelf means and base assembly, and removably secured to the structural strips and the front and rear panels, and g) spaced apart bars connected to said structural strips, of a sufficient height to retain infants or invalids within the bed apparatus.

2. The bed apparatus of claim 1 wherein said tether arm is held by each upper support means in a rotatable manner by friction-reducing bearing means.

3. The bed apparatus of claim 1 wherein said lower support means comprise friction-reducing bearing means which permits rotational movement of said tether arm.

* * * * *